US009066538B2

(12) United States Patent
Chen et al.

(10) Patent No.: US 9,066,538 B2
(45) Date of Patent: Jun. 30, 2015

(54) CURED TOBACCO AND METHOD THEREFOR

(75) Inventors: Gong Chen, Clemmons, NC (US); Michael Francis Dube, Winston-Salem, NC (US); Daniel Verdin Cantrell, Lewisville, NC (US); Jerry Wayne Marshall, Stokesdale, NC (US); Frank Kelley St. Charles, Bowling Green, KY (US); Huamin Gan, Clemmons, NC (US); Cheryl Cooper Scott, Lewisville, NC (US); Barry Smith Fagg, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1138 days.

(21) Appl. No.: 13/048,584

(22) Filed: Mar. 15, 2011

(65) Prior Publication Data

US 2012/0234334 A1 Sep. 20, 2012

(51) Int. Cl.

| | |
|---|---|
| ***A24B 3/00*** | (2006.01) |
| ***A24B 3/12*** | (2006.01) |
| ***A24B 15/18*** | (2006.01) |
| ***A24B 15/22*** | (2006.01) |

(52) U.S. Cl.

CPC ... *A24B 3/12* (2013.01); *A24B 3/00* (2013.01); *A24B 15/183* (2013.01); *A24B 15/22* (2013.01)

(58) Field of Classification Search

CPC ..... A24B 3/00

See application file for complete search history.

(56) References Cited

U.S. PATENT DOCUMENTS

| | | | | | |
|---|---|---|---|---|---|
| 1,494,307 | A | * | 5/1924 | Florent | 226/105 |
| 1,920,588 | A | * | 8/1933 | Pacini | 131/299 |
| 2,439,719 | A | * | 4/1948 | Crawford | 119/311 |
| 3,409,025 | A | * | 11/1968 | Waldemar | 131/303 |
| 3,845,774 | A | * | 11/1974 | Tso et al. | 131/309 |
| 3,927,682 | A | | 12/1975 | Matsuyama et al. | |
| 4,148,325 | A | | 4/1979 | Solomon et al. | |
| 4,178,946 | A | * | 12/1979 | Knight | 131/303 |
| RE30,693 | E | * | 8/1981 | Fredrickson | 131/296 |
| 4,512,353 | A | | 4/1985 | Brackmann | |
| 4,528,993 | A | | 7/1985 | Sensabaugh, Jr. et al. | |
| 4,624,269 | A | | 11/1986 | Story et al. | |
| 4,660,577 | A | | 4/1987 | Sensabaugh et al. | |
| 4,987,907 | A | | 1/1991 | Townend | |
| 5,092,352 | A | | 3/1992 | Sprinkle, III et al. | |
| 5,387,416 | A | | 2/1995 | White et al. | |
| 5,803,801 | A | | 9/1998 | Vrijsen | |
| 5,810,020 | A | | 9/1998 | Northway et al. | |
| 6,131,584 | A | | 10/2000 | Lauterbach | |
| 6,311,695 | B1 | * | 11/2001 | Williams | 131/299 |
| 6,510,855 | B1 | | 1/2003 | Korte et al. | |
| 6,755,200 | B1 | | 6/2004 | Hempfling et al. | |
| 6,834,654 | B2 | | 12/2004 | Williams | |
| 6,953,040 | B2 | | 10/2005 | Atchley et al. | |
| 7,025,066 | B2 | | 4/2006 | Lawson et al. | |
| 7,032,601 | B2 | | 4/2006 | Atchley et al. | |
| 7,293,564 | B2 | | 11/2007 | Perfetti et al. | |
| 2001/0000386 | A1 | | 4/2001 | Peele | |
| 2004/0250821 | A1 | | 12/2004 | Perfetti et al. | |
| 2005/0244521 | A1 | | 11/2005 | Strickland et al. | |
| 2006/0037623 | A1 | | 2/2006 | Lawrence, Jr. | |
| 2008/0245377 | A1 | | 10/2008 | Marshall et al. | |
| 2009/0293889 | A1 | | 12/2009 | Kumar et al. | |
| 2010/0154810 | A1 | | 6/2010 | Williams | |

FOREIGN PATENT DOCUMENTS

| | | | |
|---|---|---|---|
| DE | 893480 | C | 10/1953 |
| WO | WO 98/05226 | A1 | 2/1998 |
| WO | WO 98/58555 | A1 | 12/1998 |
| WO | WO 2004/095959 | A1 | 11/2004 |
| WO | WO 2005/016036 | A1 | 2/2005 |
| WO | WO 2005/041699 | A2 | 5/2005 |
| WO | WO 2005/063060 | A1 | 7/2005 |

OTHER PUBLICATIONS

International Search Report for International Application No. PCT/US2012/024799, dated May 11, 2012, 3 pages.

Written Opinion of the International Searching Authority for International Application No. PCT/US2012/024799, dated May 11, 2012, 6 pages.

* cited by examiner

*Primary Examiner* — Michael J Felton

(74) *Attorney, Agent, or Firm* — Brinks Gilson & Lione

(57) ABSTRACT

A method is provided for curing tobacco. The method includes steps of wilting, bruising, aerating, and drying tobacco, where each of the steps is measured in hours or days rather than months. In some aspects, aeration may take two to twelve hours or less. In some aspects, the entire curing method may be completed in 24 hours or less.

17 Claims, No Drawings

CURED TOBACCO AND METHOD THEREFOR

TECHNICAL FIELD

The present invention relates to products made or derived from tobacco, or that otherwise incorporate tobacco, and are intended for human consumption. Of particular interest are ingredients or components obtained or derived from tobacco plants or portions of plants from the *Nicotiana* species cured and otherwise configured for use in oral-use or smokable tobacco products.

BACKGROUND

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod" that typically includes portions from one or more *Nicotiana* species. Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The tobacco used for cigarette manufacture is typically used in blended form. For example, certain popular tobacco blends, commonly referred to as "American blends," comprise mixtures of flue-cured tobacco, burley tobacco, and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. However, for many tobacco blends, flue-cured tobacco makes up a relatively large proportion of the blend, while Oriental tobacco makes up a relatively small proportion of the blend. See, for example, Tobacco Encyclopedia, Voges (Ed.) p. 44-45 (1984), Browne, The Design of Cigarettes, 3rd Ed., p. 43 (1990) and Tobacco Production, Chemistry and Technology, Davis et al. (Eds.) p. 346 (1999).

Tobacco also may be enjoyed in a so-called "smokeless" form. Particularly popular smokeless tobacco products are employed by inserting some form of processed tobacco or tobacco-containing formulation into the mouth of the user. Various types of smokeless tobacco products are set forth in U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, Ill et al.; and U.S. Pat. No. 5,387,416 to White et al.; U.S. Pat. Appl. Pub. Nos. 2005/0244521 to Strickland et al.; and 2009/0293889 to Kumar et al.; PCT Pat. App. Publ. WO04/095959 to Arnarp et al.; PCT Pat. App. Publ. WO05/063060 to Atchley et al.; PCT Pat. App. Publ. WO05/016036 to Bjorkholm; and PCT Pat. App. Publ. WO05/041699 to Quinter et al., each of which is incorporated herein by reference. See, for example, the types of smokeless tobacco formulations, ingredients, and processing methodologies set forth in U.S. Pat. No. 6,953,040 to Atchley et al. and U.S. Pat. No. 7,032,601 to Atchley et al., each of which is incorporated herein by reference.

The manner in which various tobacco varieties are grown, harvested and processed is well known. See, Garner, USDA Bulletin No. 143, 7-54 (1909); Darkis et al, Ind. Eng. Chem., 28, 1214-1223 (1936); Bacon et al., USDA Tech. Bulletin No. 1032 (1951); Darkis et al., Ind. Eng. Chem., 44, 284-291 (1952); Bacon et al., Ind. Eng. Chem., 44, 292-309 (1952); Curing Flue-Cured Tobacco in Canada, Publication 1312/E (1987); and Suggs et al., Tob. Sci., 33, 86-90 (1989). See, also, Hawks, Jr., Principles of Flue-Cured Tobacco Production, 2.sup.Ed. (1978); Flue-Cured Tobacco Information 1993, N. C. Coop. Ext. Serv.; and Peele et al., Rec. Adv. Tob. Sci., 21, 81-123 (1995). Those references are incorporated herein by reference. In general, harvesting includes disrupting the senescence process by removing tobacco leaves from the plant at a desirable point in the plant life cycle.

It has been common practice to flue-cure certain tobaccos, such as Virginia tobaccos, in barns using a so-called flue-curing process. Cooper et al., VPI Bull., 37(6), 3-28 (1939); Brown et al., Agric. Eng., 29(3), 109-111 (1948); Johnson et al., Job. Sci., 4, 49-55 (1960); Johnson, Rec. Adv. Tob. Sci., Inag. Vol., 63-78 (1974); Peele et al., Rec. Adv. Job. Sci., 21, 81-123 (1995). Tobacco to be cured may be grown under well-known and accepted agronomic conditions, and harvested using known techniques. Such tobacco typically is referred to as green tobacco. Most preferably, the harvested tobacco is adequately ripe or mature. Peele et al., Rec. Adv. Tob. Sci., 21, 81-123 (1995). Ripe or mature tobaccos typically require shorter cure times than do unripe or immature tobaccos.

Under typical conditions green tobacco is placed in an enclosure adapted for curing tobacco, commonly referred to in the art as a curing barn. The tobacco will be subjected to curing conditions, typically involving the application of heat. The green tobacco can be placed in the barn in a variety of ways, and typically is carried out as a manner of personal preference. As such, there is wide discretion in the particular determination of the amount of tobacco placed within the barn, the packing density of that tobacco within a box, the spacing of the tobacco within the barn, and the location of various tobacco samples within the barn. See, for example, U.S. Pat. App. Pub. 2001/0386 to Peele and Tobacco Production, Chemistry and Technology, Davis et al. (Eds.) p. 131-133 (1999). Fire-curing, air-curing, sun-curing, and other curing processes are also known in the art.

The conditions of temperature to which the tobacco is exposed during curing can vary. The time frame over which curing of the tobacco occurs also can vary. For the flue-curing of Virginia tobaccos, the temperature to which the tobacco is exposed typically is in the range of about 35° C. to about 75° C.; and the time over which the tobacco is exposed to those elevated temperatures usually is at least about 120 hours, but usually is less than about 200 hours. Curing temperatures reported herein generally are representative of the average air temperature within the curing barn during curing process steps. Average air temperatures can be taken at one or more points or locations within the curing barn that give an accurate indication of the temperature that the tobacco experiences during curing steps. Typically, Virginia tobacco first is subjected to a yellowing treatment step whereby the tobacco is heated at about 35° C. to about 40° C. for about 24 to about 72 hours, preferably about 36 to about 60 hours; then is subjected to a leaf drying treatment step whereby the tobacco is heated at about 40° C. to about 57° C. for about 48 hours; and then is subjected to a midrib (i.e., stem) drying treatment step whereby the tobacco is heated at about 57° C. to about 75° C. for about 48 hours. Exposing Virginia tobacco to temperatures above about 70° C. to about 75° C. during curing is not desirable, as exposure of the tobacco to exceedingly high temperatures, even for short periods of time, can have the effect of decreasing the quality of the cured tobacco. Typically, some ambient air preferably is introduced into the barn during the yellowing stage, significantly more ambient air preferably is introduced into the barn during the leaf drying stage, and heated air preferably is recirculated within the barn during midrib drying stage. The relative humidity within the barn during curing varies, and is observed to change during curing. Typically, a relative humidity of about 85 percent is maintained within the curing barn during the yellowing stage, but then is observed to decrease steadily during leaf drying and midrib drying stages. Of course, fire curing and air curing each provide different conditions of temperature, humidity, and times for various curing steps.

After the tobacco is exposed to curing conditions, the use of heating is stopped. Typically, the fresh air dampers of the barn are opened in order to allow contact of ambient air with that tobacco. As such, moisture within the ambient air is allowed to moisten the tobacco; and the very dry freshly cured tobacco is rendered less brittle. The cooled tobacco then is taken down, and the tobacco is removed from the curing barn. Commonly, fire-cured tobaccos for oral-use tobacco are stored and aged for at least three years after curing is complete, during which time anaerobic fermentation occurs. After this, period of anaerobic fermentation storage, the aged tobacco undergoes 5 to 8 weeks of aerobic fermentation in preparation for use in modern moist snuff products, which generally reduces the presence of bitterness-causing compounds in the tobacco.

However, bitterness often remains in the tobacco, requiring the addition of masking flavorants or treatment with chemicals to reduce bitterness. The long time taken for this traditional curing and aging process incurs expenses and delays in production of oral-use/smokeless tobacco. In addition, this process may result in levels of tobacco-specific nitrosamines that are undesirable. Nitrosamines are known to be present in air, foods, beverages, cosmetics, and even pharmaceuticals. Preussman et al., Chemical Carcinogens, 2.sup.nd Ed., Vol. 2, Searle (Ed.) ACS Monograph 182, 829-868 (1984). Tobacco and tobacco smoke also are known to contain nitrosamines. Green et al., Rec. Adv. Tob. Sci., 22, 131 (1996). Tobacco is known to contain a class of nitrosamines known as tobacco specific nitrosamines (TSNAs). Hecht, Chem. Res. Toxicol., 11(6), 559-603 (1998); Hecht, Mut. Res., 424(1,2), 127-142 (1999). TSNAs have been reported to be present in smokeless tobacco, Brunnemann et al., Canc. Lett., 37, 7-16 (1987), Tricker, Canc. Lett., 42, 113-118 (1988), Andersen et al., Canc. Res., 49, 5895-5900 (1989); cigarette smoke, Spiegelhalder et al., Euro. J. Canc. Prey., 5(1), 33-38 (1996); Hoffman et al., J. Toxicol. Env. Hlth., 50, 307-364 (1997); Borgerding et al., Food Chem. Toxicol., 36, 169-182 (1997); nicotine-containing gum, Osterdahl, Food Chem. Toxic., 28(9), 619-622 (1990); and nicotine-containing transdermal patch, Adlkofer, In: Clarke et al. (Eds.), Effects of Nicotine on Biological Systems II, 17-25 (1995).

Green and freshly harvested tobaccos have reported to be virtually free of TSNAs. Parsons, Tob. Sci., 30, 81-82 (1986); Spiegelhalder et al., Euro. J. Canc. Prey., 5(1), 33-38 (1996); Brunnemann et al., J. Toxicol.-Clin. Toxicol., 19(6&7), 661-668 (1982-3); Andersen et al., J. Agric. Food Chem., 37(1), 44-50 (1989); Djordjevic et al., J. Agric. Food Chem., 37, 752-756 (1989). However, it has been observed that TSNAs form during the post-harvest processing to which tobacco is subjected. Tricker, Canc. Lett., 42, 113-118 (1988); Chamberlain et al., J. Agric. Food Chem., 36, 48-50 (1988). TSNAs are recognized as being formed when tobacco alkaloids, such as nicotine, are nitrosated. Hecht, Chem. Res. Toxicol., 11(6), 559-603 (1998). There has been considerable effort expended toward studying the mechanism of formation of TSNAs.

Significant efforts have been expended towards studying the mechanism of TSNAs' formation during tobacco curing, particularly for Burley tobacco. As a result, it has been postulated that TSNAs form during the air-curing of Burley tobacco as a result of microbial mediated conversion of nitrate to nitrite, and the subsequent reaction of nitrate-derived chemical species with alkaloids present in the tobacco. Hamilton et al., Tob. Sci., 26, 133-137 (1982); Burton et al., J. Agric. Food Chem., 40, 1050-1055 (1992); Bush et al., Coresta Bulletin Information, Abstract 9814 (1995); Wiernik et al., Rec. Adv. Tob. Sci., 21, 39-80 (1995); Cui et al., TCRC (1996). It also has been suggested that the mechanism by which TSNAs form during the flue-curing of Virginia tobaccos is similar to that mechanism postulated for air-cured Burley tobacco. See, Djordjevic et al., J. Agric. Food Chem., 37, 752-756 (1989) and Peele et al., Coresta Bulletin Information, Abstract 9822 (1995). See also, PCT WO 98/05226 and PCT WO 98/58555, and U.S. Pat. No. 5,803,801 to O'Donnell et at.

It has been known practice to cure certain types of tobaccos, particularly specialty tobaccos, using a so-called fire-curing process. Legg et al., TCRC (1986). It also has been common practice to flue-cure certain tobaccos, such as Virginia tobaccos, in barns using a so-called flue-curing process, one general description of which is included above. See also Cooper et al., VPI Bull., 37(6), 3-28 (1939); Brown et al., Agric. Eng., 29(3), 109-111 (1948); Johnson et al., Tob. Sci., 4, 49-55 (1960); Peele et al., Rec. Adv. Tob. Sci., 21, 81-123 (1995). Tobacco leaf is harvested, placed in barns, and subjected to the application of heat. In recent years, it has been common practice, particularly in North America, to cure tobacco using a so-called direct-fire curing technique. Typical direct-fire heating units are powered by propane, and during use, those heating units produce exhaust gases that come into contact with the tobacco being cured. As a result, it is common for tobacco being cured to be exposed to propane combustion products, including nitric oxides that may be present in those exhaust gases; and it is not uncommon for tobacco within a curing barn to be exposed to about 0.5 to about 2 kilogram of nitric oxide during a typical curing cycle of about 6 days in duration.

Tobaccos of a particular type that are cured using flue-curing techniques have been reported to provide higher levels of TSNAs relative to similar tobaccos of like type that are air-cured. Chamberlain et al., Beitr. Tabak., 15(2), 87-92 (1992). Furthermore, potential relationships between so-called direct-fire heating techniques and the formation of nitrosamines have been investigated in industries outside of the tobacco industry. IARC Monograph, 17, 35-47 (1978); Stehlik et al., Ecotoxicol. Envir. Saf., 6, 495-500 (1982); Scanlan et al., In: Loeppky et al. (Eds.) Nitrosamines and Related N-Nitroso Compounds, 34-41 (1994). However, direct-fire heating techniques have not always been associated with the formation of nitrosamines. Larsson et al., Swedish J. Agric. Sci., 20(2), 49-56 (1990).

Attempts have been made to reduce the TSNAs levels within tobacco. For example, it has been suggested that control of the temperature and moisture during air-curing may have an effect upon lowering TSNAs levels within air-cured tobaccos, such as Burley tobacco. See, IARC Monograph, 84, 451-455 (1986). It has been proposed to process tobacco to remove TSNAs; such as by the manner that is described in U.S. Pat. No. 5,810,020 to Northway et al. It also has been proposed to cure tobacco in conjunction with the application of microwave radiation and high temperature treatment in order to provide a tobacco possessing extremely low TSNAs levels. See PCT WO 98/05226 and PCT WO 98/58555, and U.S. Pat. No. 5,803,801 to O'Donnell et al. At least one method of chemically modifying tobacco during curing to decrease TSNAs has been presented in U.S. Pat. No. 7,293,564 to Perfetti et al. In keeping with principles of the present invention, low-temperature curing and salt curing process steps may also help reduce final TSNA levels.

One type of smokeless tobacco product is referred to as "snuff." Representative types of moist snuff products, including those types commonly referred to as "snus," have been manufactured in Europe, particularly in Sweden, by or through companies such as Swedish Match AB, Fiedler & Lundgren AB, Gustavus AB, Skandinavisk Tobakskompagni NS, and Rocker Production AB. Exemplary smokeless tobacco products that have been marketed include those referred to as CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR' PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA. Representative smokeless tobacco products also have been marketed under the tradenames Oliver Twist by House of Oliver Twist A/S. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard.

The types of processes and times involved in processing tobacco for curing vary, and include air curing, flue curing, fire curing, and other curing processes. It would be desirable to provide methods for altering the character and nature of tobacco (and tobacco compositions and formulations) useful in the manufacture of smokeless tobacco products. In particular is would be desirable to provide cured tobacco and methods for preparation of same that include shorter curing time, reduced bitterness, and reduced TSNA presence.

BRIEF SUMMARY

In one aspect, embodiments of the present invention may include tobacco and tobacco products, as well as methods for curing tobacco. In another aspect, embodiments of the present invention may include methods of curing tobacco, where the methods include steps of wilting, bruising, aerating, and drying tobacco.

In certain aspects, methods of the present invention may provide cured tobacco with reduced bitterness, shorter curing time, and lower content of some TSNA in comparison to traditionally-cured oral-use tobacco. In one aspect, the invention may include a tobacco composition for use in a smokeless tobacco product comprising a tobacco material cured according to a method described herein.

DETAILED DESCRIPTION

The relationship and functioning of the various elements of the embodiments may better be understood by reference to the following detailed description. However, embodiments are not limited to those expressly detailed herein, as—in view of the present disclosure—those of skill in the art will be enabled to utilize different aspects of embodiments disclosed herein, all within the scope of the present invention. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water). Moisture content descriptions given as "X%" are made with reference to weight percent of water in the material described.

In certain aspects, methods of the present invention may provide a curing process that is much shorter in duration than traditionally used for oral use tobacco and other tobacco products. Those of skill in the art and those conversant with the business of tobacco will immediately appreciate the improvements in efficiency and the cost-savings associated with a curing process that provides tobacco ready for final processing into oral-use tobacco in a matter of hours or a few days rather than the months and even years associated with current processes. In addition to the significant production efficiencies associated with the reduced time of curing and the elimination of the aging/fermentation process, the final product includes desirable features that are superior to traditionally-produced oral-use/smokeless tobacco. The tobacco produced will generally include less bitterness and lower TSNA content than oral use tobaccos provided by other methods now known and used in the art.

The selection of tobacco from one or more *Nicotiana* species can vary; and in particular, the types of tobacco or tobaccos may vary. Tobaccos that can be employed include Virginia (e.g., K326), burley, Indian Kurnool and Oriental tobaccos including Katerini, Prelip, Komotini, Xanthi and Yambol tobaccos, Maryland, Passanda, Cubano, Jatin and Bezuki tobaccos, North Wisconsin and Galpao tobaccos, Red Russian and Rustica tobaccos, as well as various other rare or specialty tobaccos. Descriptions of various types of tobaccos, growing practices and harvesting practices are set forth in Tobacco Production, Chemistry and Technology, Davis et al. (Eds.) (1999), which is incorporated herein by reference. Various representative types of plants from the *Nicotiana* species are set forth in Goodspeed, The Genus *Nicotiana,* (Chonica Botanica) (1954); U.S. Pat. No. 4,660,577 to Sensabaugh, Jr. et al.; U.S. Pat. No. 5,387,416 to White et al. and U.S. Pat. No. 7,025,066 to Lawson et al.; U.S. Pat. Appl. Pub. Nos. 2006/0037623 to Lawrence, Jr. and 2008/0245377 to Marshall et al.; each of which is incorporated herein by reference.

As described in the background section of this document, harvested plants of the *Nicotiana* species typically are subjected to a curing process. Preferably, harvested tobaccos that are cured are then aged. At least a portion of the plant of the *Nicotiana* species (e.g., at least a portion of the tobacco portion) can be employed in an immature form. That is, the plant, or at least one portion of that plant, can be harvested before reaching a stage normally regarded as ripe or mature. As such, for example, tobacco can be harvested when the tobacco plant is at the point of a sprout, is commencing leaf formation, is commencing seeding, is commencing flowering, or the like.

At least a portion of the plant of the *Nicotiana* species (e.g., at least a portion of the tobacco portion) can be employed in a mature form. That is, the plant, or at least one portion of that plant, can be harvested when that plant (or plant portion) reaches a point that is traditionally viewed as being ripe, over-ripe or mature. As such, for example, through the use of tobacco harvesting techniques conventionally employed by farmers, Oriental tobacco plants can be harvested, burley tobacco plants can be harvested, or Virginia tobacco leaves can be harvested or primed by stalk position.

After harvest, the plant of the *Nicotiana* species, or portion thereof, may be used in a green form (e.g., tobacco can be used without being subjected to any curing process). For example, in traditional uses, tobacco in green form can be frozen, freeze-dried, subjected to irradiation, yellowed, dried, cooked (e.g., roasted, fried or boiled), or otherwise subjected to storage or treatment for later use. Such tobacco also can be subjected to aging conditions.

In accordance with the present invention, tobacco may be subjected to a curing process without aging that may be used to provide a desirable tobacco product suitable for oral use. The tobacco product preferably will provide taste and texture desirable to users. It preferably will not include the bitterness associated with traditional aging and curing techniques, It preferably will include markedly less TSNA than oral use tobacco processed with traditional aging and curing techniques.

Methods in accordance with the present invention and configured for producing a desirable oral-use tobacco are here described.

A processor first receives fresh green leaf tobacco. The leaves may be washed with a minimal amount of water sufficient to remove the detritus associated with growing and harvesting tobacco leaves (dirt, sand insect parts, dust, etc.). They may be irradiated to reduce or eliminate microflora, including those implicated in production of TSNAs. The irradiation may be done at this initial phase, or at a later time. Other methods of microflora that may be used instead or in addition include biocide application and rinsing/washing (e.g., such as, for example, the double- or triple-washing protocols applied to food-grade fresh produce). One specific example of rinsing includes a double wash by spraying with tap water, which is employed post-harvest to remove dirt, insects and microorganisms. Another example is a "triple wash" similar to that used commercially for green leafy vegetables, which includes a first wash by spraying or immersion to remove dirt, a second wash by spraying or immersion in a disinfecting solution (e.g. free chlorine above 50 ppm), and a final spray using non-recirculated water to remove the disinfecting solution. The midribs of the stems on the leaves may be removed at this cleaning stage or after the wilting step.

Next, the leaves are wilted to reduce their moisture content from a typical harvesting level of about 85%. The moisture content may be reduced below about 70%, may be reduced to about 64% to about 68%, but preferably will be reduced to a moisture content at least in a range of about 60-75%, but generally will not be reduced below about 50%. Unwilted leaves typically begin as turgid, and the wilting processes described herein leave the leaves more pliable and not easily broken. With the leaves spread out and exposed at normal indoor room temperature and humidity (about 20-24° C., with about 50% humidity), this step may take about 18 hours. However, those of skill in the art will appreciate that this time may vary depending upon the ambient temperature, humidity, air-flow, etc. For example wilting may take about 5 to about 8 hours, depending upon temperature, relative humidity, and bed depth of tobacco. This wilting may be done on a suitable conveyer belt or by hanging the leaves, suitably spaced, in a warm area with air circulation.

If the midribs of the leaves were not removed before wilting, they may be removed before proceeding to the next step.

After midrib removal and wilting, the leaves are chopped, torn, shredded, cut, or otherwise rendered into smaller pieces (including any combination thereof) to leave pieces about 3 to about 7 mm (about ⅛ to about ¼ inches) in length. This may be done manually or in automated fashion using a commercial chopping apparatus such as a food processor (in small scale production), or equivalent mechanical device configured for large scale commercial production. Preferably, this action "bruises" the leaf surfaces, which releases polyphenols from the leaf cells (for example, enzymes such as polyphenol oxidase—the enzyme that causes browning in cut fruit—may be released). This stands in contrast with many traditional curing methods, where bruising is strenuously avoided. The tobacco does not need to be cut or chopped, as any action (such as—for example—rolling, pressing, or pounding) that bruises the leaves in a manner disrupting cell walls and allowing moisture to be released from inside the cell walls may be useful within the presently described embodiments. If the leaves are not cut or chopped at this stage, they may be cut or chopped at a later stage, as needed for the tobacco to be in a usable form for a desired end use (e.g., oral use, smoking tobacco, etc.).

Flue-curing and most sun-curing regimes prevent or limit the oxidation of polyphenols. Air-curing of the present methods promotes the oxidation of polyphenols. Polyphenol oxidation occurs in conventional air-cured and some sun-cured tobaccos as the leaf cells lose their structural integrity, rupture, and the hydrated polyphenols are exposed to air. Flue-curing and most sun-curing regimes remove the moisture prior to cell wall rupture, thus preventing the polyphenols from oxidizing. However, extended yellowing or failure to correctly remove enough moisture in a flue-curing regime prior to increasing the temperature to 57° C. (135° F.) will cause polyphenol oxidation. In conventional flue, sun, and air-curing regimes many chemical changes occur during the yellowing and drying stages i.e. starch conversion to sugar, protein deconstruction, etc. In contrast, the type of cure described herein allows a controlled polyphenol oxidation process that is independent of other chemical and structural states that occur in conventional curing processes.

Then, the cut/chopped tobacco pieces are spread out or tumbled for aeration that will allow oxidation. It is preferable that the pieces are spread out substantially in a single layer on an aeration table, screen, non-stick metal surface, conveyor belt, or other surface configured to provide desirably efficient air flow around the pieces to provide aeration of the tobacco leaves. Other options include placing the tobacco into tumbling canisters or bins or other container(s) that allow aeration, onto a conveyor (e.g., conveyor belt(s), platforms, racks) or other surfaces that may be configured to hold/move the tobacco for an appropriate time to allow aeration, and providing for air flow around the tobacco. A tumbling canister may be configured as a tilted or horizontal rotating container (e.g., like a clothes dryer or cement mixer), and/or it may include one or more mixing/spreading arms (e.g., like a kitchen mixer). If spread out on a flat, generally non-porous surface, the aeration step may take three to six times as long than if an aeration table or other surface or container configured to enhance efficient aeration is used. Using an aeration table, the aeration step may take only about one hour or less. Generally, the aeration step may take 12 hours or less; sometimes, the aeration may 9 hours or less; frequently, the aeration may take 6 hours or less; often, the aeration may take 4 hours or less; and, the aeration may take 2 hours or less.

As one example, the rendered (e.g., chopped, torn, etc.) tobacco may be placed in the tumbling drum (or pancoater), where additional rubbing and bruising may be achieved during movement of the tobacco pieces. This process may be referred to as "oxidation with tumbling." During tumbling and non-tumbling processes, the tobacco material, including the liberated liquid and enzymes, will be exposed to oxygen and chemical or biochemical changes allowed to occur. The degree of oxidation may vary relative to the time exposed to the air and air moisture level. Under conditions where air moisture may be about 50% moisture or greater, an oxidation processing step may take from about 1 to about 6 hours.

During aeration, as a result of oxidative processes the tobacco changes color from the green leaf to a mottled green-brown to a dark brown. The color changes provide a visual indicator of the chemical reactions occurring naturally within the leaf and may be used to help determine when the aeration is complete. Of course, other methods of testing the leaves are known in the art to determine desirable aeration/oxidation levels. The aeration step may also be carried out in the same or similar ambient conditions described above for wilting. At this and/or other steps of the present method, the tobacco may be exposed to ethylene. Ethylene exposure may stimulate chemical changes including, for example, breakdown of chlorophyll, which may be associated with flavor changes observable in tobacco products (e.g., oral use tobacco).

Next, the brown-colored leaves may be dried using a drier (e.g., convection oven, or other drying apparatus that will preferably provide even heating). The drying process may stop and/or stabilize oxidation. The drier may be set at about 120° C. (about 250° F.) for about 45 to about 60 minutes, or such time as is needed to reduce the moisture content of the leaves that may be below about 20%, will often be below about 15%, and preferably will be below about 10%. It is preferable that the moisture content remain greater than 0% to avoid brittleness in the leaf pieces, and it will be appreciated by those having skill in the art that the moisture level most desirable will vary between different tobaccos correlating with differences in leaf thickness, density, and other compositional factors affecting the stability of the leaves' structure following this curing process. This may be accomplished in part by providing a drying chamber (e.g., oven) that continuously, periodically, or occasionally admits fresh air. This rapid drying step may reduce TSNA formation as compared to traditional air-curing and flue-curing methods.

After the leaves are dry, they may be stored for eventual use. For oral use tobaccos, they will likely be treated with flavors desired by users, and may—for example—be treated with moisturizing materials, put into pouches (e.g., for use as snus), or otherwise processed and/or packaged into a user-friendly form. Further processing may include cutting the tobacco into finer pieces and/or processing it into a granular tobacco form that may be sized to pass through a screen of 60 Tyler mesh, a screen of 150 Tyler mesh, or a screen of 200 Tyler mesh.

As compared to flue cured Virginia and other varieties of tobacco, tobacco processed by the methods described here may have final specific TSNA (e.g., NNK (4-(methylnitrosamino)-1(3-pyridyl)-1-butanone)) levels below levels that can accurately be quantified. For example, samples of green tobacco were subjected to wilting and oxidation over 2-, 4-, and 6-hour periods. Whether the oxidation took place on a flat surface or in a tumbling canister, total TSNAs were below about 2 μg/g. Of the total TSNA, NNK was too low to quantify accurately (below about 81 ng/g). Total TSNA content may further be reduced by maintaining a lower temperature (e.g., below about 60° F. (below about 16° C.)) throughout processing, as may early irradiation, or treatment with biocide. The samples were taste-tested by users, with favorable acceptance and rating of taste for samples allowed to oxidize for about two to about four hours in a method as described above. As such, in one aspect, the present invention may include a portion of tobacco cured by one of the methods embodied herein.

The method embodiments as described may be measured in hours or in a small number of days rather than in many days or months, which is the time period associated with many other curing methods. As described above, in some embodiments, the entire curing process may be completed in 24 hours or less, and in many instances may be completed in less than 48 hours.

Tobacco cured by methods of the present invention may be used in smokable articles such as, for example, cigarettes, or may be used in smokeless tobacco products. A final tobacco product may include a powdered or granular smokeless tobacco formulation that is contained within a moisture-permeable container. Such a smokeless tobacco formulation may include granular particles of tobacco and other ingredients, such as sweeteners, binders, colorants, pH adjusters, fillers, flavoring agents, disintegration aids, antioxidants, and preservatives. The container may be configured in the form of a pouch or bag, such as is those known in the manufacture of snus types of products. The container is configured to be placed in the mouth of the tobacco user, in order that the dry or somewhat moistened tobacco formulation within the container can be enjoyed by the user. After the tobacco user is finished using the smokeless tobacco product, the container may be removed from the user's mouth for disposal. Some pouches or other containers may be manufactured from a water dissolvable or dispersible material, such that the tobacco formulation and the container each may be wholly ingested by the user.

The tobacco cured by this process may be used for the manufacture of the tobacco product by further being processed into a ground, granulated, fine particulate or powder form. In some embodiments, the tobacco will be employed in the form of parts or pieces that have an average particle size less than that of the parts or pieces of shredded tobacco used in so-called "fine cut" tobacco products. Some very finely divided tobacco particles or pieces may be sized to pass through a screen of 20 Tyler mesh, a screen of 60 Tyler mesh, a screen of 100 Tyler mesh, or a screen of 200 Tyler mesh, with the latter sizes being preferred for some ingestible embodiments. If desired, air classification equipment may be used in order to ensure that small sized tobacco particles of the desired sizes, or range of sizes, may be collected.

The manner by which the tobacco is provided in a finely divided or powder type of form may vary. For example, the tobacco pieces from the above-described curing process may be comminuted, ground or pulverized into a powder type of form using equipment and techniques for grinding, milling, or the like. As described with reference the curing process of the present invention, the cured tobacco will be relatively dry in form during grinding or milling, which may use equipment such as hammer mills, cutter heads, air control mills, or the like. For example, tobacco parts or pieces may be ground or milled when the moisture content thereof is less than about 15% to less than about 5%. The tobacco may also be irradiated or pasteurized.

If desired, the cured tobacco material may be cased and dried, and then ground to the desired form. For example, the tobacco material may be cased with an aqueous casing containing components such as sugars (e.g., fructose, glucose and sucrose), humectants (e.g., glycerin and propylene glycol), flavoring agents (e.g., cocoa and licorice), and the like. Non-aqueous casing components preferably are applied to the tobacco in amounts of about 1% to about 15%, based on the dry weight of the tobacco.

A final tobacco formulation may incorporate other components in addition to tobacco. Those components may alter the nature of the flavor provided by that formulation. For example, those components, or suitable combinations of those components, may act to alter the bitterness, sweetness, sourness or saltiness of the formulation; enhance the perceived dryness or moistness of the formulation; or the degree of tobacco taste exhibited by the formulation. Such other components may include salts (e.g., sodium chloride, potassium chloride, sodium citrate, potassium citrate, sodium acetate, potassium acetate, and the like); natural sweeteners (e.g., fructose, sucrose, glucose, maltose, mannose, galactose, lactose, and the like); artificial sweeteners (e.g., sucralose, saccharin, aspartame, acesulfame K, and the like), organic and inorganic fillers (e.g., grains, processed grains, puffed grains, maltodextrin, dextrose, calcium carbonate, calcium phosphate, corn starch, lactose, manitol, xylitol, sorbitol, finely divided cellulose, and the like); binders (e.g., povidone, sodium carboxymethylcellulose and other modified cellulosic types of binders, sodium alginate, xanthan gum, starch-based binders, gum arabic, lecithin, and the like); pH adjusters or buffering agents (e.g., metal hydroxides, preferably alkali metal hydroxides such as sodium hydroxide and potassium hydroxide, and other alkali metal buffers such as potassium carbonate, sodium carbonate, sodium bicarbonate, and the like); colorants (e.g., dyes and pigments, including caramel coloring and titanium dioxide, and the like); humectants (e.g. glycerin, propylene glycol, and the like); preservatives (e.g., potassium sorbate, and the like); syrups (e.g., honey, high fructose corn syrup, and the like); disintegration aids (e.g., microcrystalline cellulose, croscarmellose sodium, crospovidone, sodium starch glycolate, pregelatinized corn starch, and the like); antioxidants (e.g., ascorbic acid, grape seed extracts and oils, polyphenol-containing materials such as green tea extract and black tea extract, peanut endocarb, potato peel, and the like; see Santhosh et al., Phytomedicine, 12(2005) 216-220, which is incorporated herein by reference); and flavoring agents/flavorants. Flavoring agents may be natural or synthetic, and the character of these flavors may be described, without limitation, as fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamom, nutmeg, cinnamon, clove, cascarilla, sandalwood, honey, jasmine, ginger, anise, sage, licorice, lemon, orange, apple, peach, lime, cherry, and strawberry. See also, Leffingwell et al., Tobacco Flavoring for Smoking Products, R. J. Reynolds Tobacco Company (1972). Flavorings also may include components that are considered moistening, cooling or smoothening agents, such as eucalyptus. These flavors may be provided neat (i.e., alone) or in a composite (e.g., spearmint and menthol, or orange and cinnamon). Representative types of components also are set forth in U.S. Pat. No. 5,387,416 to White et al. and PCT Application Pub. No. WO 2005/041699 to Quinter et al., each of which is incorporated herein by reference.

The amount of tobacco within the tobacco formulation may vary. Preferably, the amount of tobacco within the tobacco formulation is at least about 25% to at least about 40%, on a dry weight basis. The amounts of other components within the tobacco formulation may be in excess of about 25% to in excess of about 40%, on a dry weight basis, and may exceed 90-95%.

The relative amounts of other components within the tobacco formulation may vary. Any sweetener used most preferably is employed in amounts sufficient in order to provide desired flavor attributes to the tobacco formulation. When present, a representative amount of sweetener, whether an artificial sweetener and/or natural sugar, may make up at least about 1% to at least about 3%, of the total dry weight of the formulation. Preferably, the amount of sweetener within the formulation will not exceed about 40%, often will not exceed about 35%, and frequently will not exceed about 30%, of the total dry weight of the formulation. A binder may be employed in amounts sufficient in order to provide the desired physical attributes and physical integrity to the tobacco formulation. When present, a representative amount of binder may make up at least about 1% to at least about 3% of the total dry weight of the formulation. Preferably, the amount of binder within the formulation will not exceed about 20% of the total dry weight of the formulation. Often, often the amount of binder within a desirable formulation will not exceed about 15%, and frequently will not exceed about 10%, of the total dry weight of the formulation.

A disintegration aid may be employed in an amount sufficient to provide control of desired physical attributes of the tobacco formulation such as, for example, by providing loss of physical integrity and dispersion of the various component materials upon contact of the formulation with water (e.g., by undergoing swelling upon contact with water). When present, a representative amount of disintegration aid may make up at least about 1% to at least about 10% of the total dry weight of the formulation. Preferably, the amount of disintegration aid within the formulation will not exceed about 50%, and frequently will not exceed about 30%, of the total dry weight of the formulation.

A colorant may be employed in amounts sufficient in order to provide the desired visual attributes to the tobacco formulation. When present, a representative amount of colorant may make up at least about 1% to at least about 3%, of the total dry weight of the formulation. Preferably, the amount of colorant within the formulation will not exceed about 30%, and frequently will not exceed about 10%, of the total dry weight of the formulation. The filler preferably is employed in amounts sufficient in order to provide control of desired physical attributes and sensory attributes to the tobacco formulation. When present, a representative amount of filler, whether an organic and/or inorganic filler, may make up at least about 5% to at least about 15%, of the total dry weight of the formulation. Preferably, the amount of filler within the formulation will not exceed about 60%, and frequently will not exceed about 40%, of the total dry weight of the formulation. When present, a representative amount of buffering or pH adjusting agent may make up at least about 1% to at least about 3% of the total dry weight of the formulation. Preferably, the amount of buffering or pH adjusting agent within the formulation will not exceed about 10%, and frequently will not exceed about 5%, of the total dry weight of the formulation.

A flavoring agent will often employed in amounts sufficient in order to provide desired sensory attributes to the tobacco formulation. When present, a representative amount of flavoring agent may make up at least about 1% to at least about 3% of the total dry weight of the formulation. Preferably, the amount of flavoring agent will not exceed about 15%, and frequently will not exceed about 5%, of the total dry weight of the formulation. A salt may be employed in amounts sufficient in order to provide desired sensory attributes to the tobacco formulation. When present, a representative amount of salt may make up at least about 1% to at least about 3% of the total dry weight of the formulation. Preferably, the amount of salt within the formulation will not exceed about 10%, and frequently does not exceed about 5%, of the total dry weight of the formulation. When present, a representative amount of antioxidant, may make up at least about 1% to at least about 3%, of the total dry weight of the formulation. Preferably, the amount of antioxidant within the formulation will not exceed about 25%, and frequently will not exceed about 10%, of the total dry weight of the formulation. When present, a representative amount of preservative may make up at least about 0.1% to at least about 1%, of the total dry weight of the formulation. Preferably, the amount of preservative within the formulation will not exceed about 5%, and frequently will not exceed about 3%, of the total dry weight of the formulation.

Representative tobacco formulations may incorporate (on a dry weight basis) about 25 to about 60% tobacco, about 1 to about 5% artificial sweetener, about 1 to about 5% colorant, about 10 to about 60% organic and/or inorganic filler, about 5 to about 20% disintegrating aid, about 1 to about 5% binder, about 1 to about 5% pH-adjusting/buffering agent, flavoring agent in an amount of up to about 10%, preservative in an amount up to about 2%, and salt in an amount up to about 5%, based on the total dry weight of the tobacco formulation. The particular percentages and choice of ingredients will vary depending upon the desired flavor, texture, and other characteristics.

The manner by which the various components of a tobacco formulation using tobacco cured in the manner described here will be combined may vary. The various components of the formulation may be contacted, combined, or mixed together in conical-type blenders, mixing drums, ribbon blenders, or the like. As such, the overall mixture of various components with the powdered tobacco components may be relatively uniform in nature in a final product, which will be desirable for maintaining consistent and uniform traits across different samples and batches of final commercial products. See also, for example, the types methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference.

The moisture content of the tobacco formulation prior to use by a consumer of the formulation may vary. Typically, the moisture content of the tobacco formulation, as present within the pouch prior to insertion into the mouth of the user, will be less than 40% and may be less than 15%. Certain tobacco formulations will have moisture contents, prior to use, of less than 10% to less than 5%.

The manner by which the moisture content of the formulation is controlled may vary. For example the formulation may be subjected to thermal or convention heating. As a specific example, the formulation may be oven-dried, in warmed air at temperatures of about 40° C. to about 95° C., with a preferred temperature range of about 60° C. to about 80° C. for a length of time appropriate to attain the desired moisture content.

The tobacco formulation used for the manufacture of the tobacco product preferably is provided in a ground, granulated, fine particulate or powder form. Although not preferred, the tobacco formulation may be subjected to processing steps that provide a further grinding, and hence additional or further particle size reduction.

The pH of the formulation may vary, but will generally be controlled not to interfere with desirable flavor and mouthfeel for a user. Typically, the pH of the formulation may be at least about 6.5 and often about 7.5. Typically, the pH of the formulation will not exceed about 9, and often will not exceed about 8.5. A representative formulation exhibits a pH of about 6.8 to about 8.2. A representative technique for determining the pH of the formulation involve dispersing 2 g of the formulation in 10 ml of high performance liquid chromatography water, and measuring pH using a pH meter.

If desired, prior to preparation of the formulation, the tobacco parts or pieces may be irradiated, or those parts and pieces may be pasteurized, or otherwise subjected to controlled heat treatment. If desired, after preparation of all or a portion of the formulation, the component materials may be irradiated, or those component materials may be pasteurized, or otherwise subjected to controlled heat treatment. For example, a formulation may be prepared, followed by irradiation or pasteurization, and then flavoring agents may be applied to the formulation.

Those of skill in the art will appreciate that embodiments not expressly illustrated herein may be practiced within the scope of the present invention, including that features described herein for different embodiments may be combined with each other and/or with currently-known or future-developed technologies while remaining within the scope of the claims presented here. Although specific terms are employed herein, they are used in a generic and descriptive sense only and not for purposes of limitation. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment of the invention.

We claim:

1. A method for curing tobacco, said method comprising steps of:

receiving green leaf tobacco;

wilting the tobacco to reduce its moisture content;

next bruising the tobacco, including chopping, cutting, tearing, or shredding the tobacco, or any combination thereof;

next aerating the tobacco in a manner configured to promote oxidation; and thereafter drying the tobacco to a moisture content below about 20%;

wherein the step of aerating comprises spreading the tobacco out substantially in a single layer upon a surface configured to provide air flow around the tobacco and is conducted for twelve hours or less.

2. The method of claim 1, further comprising a step of irradiating the tobacco to reduce microflora.

3. The method of claim 1, further comprising a step of removing midribs from leaves of the tobacco before the step of bruising.

4. The method of claim 1, further comprising a step of applying a biocide to the tobacco and/or a step of washing the tobacco-to reduce microflora.

5. The method of claim 1, wherein the step of bruising further comprises rolling, pressing, pounding, the tobacco, or any combination thereof.

6. The method of claim 1, wherein the surface is configured as a conveyor.

7. The method of claim 1, wherein the step of aerating is conducted for six hours or less.

8. The method of claim 1, wherein the step of aerating is conducted for four hours or less.

9. The method of claim 1, wherein the step of aerating is conducted for two hours or less.

10. The method of claim 1, wherein the step of drying comprises drying the tobacco to a moisture content below about 15%.

11. The method of claim 1, wherein the step of drying comprises drying the tobacco to a moisture content below about 10%.

12. A portion of tobacco cured according to the method of claim 1.

13. A tobacco product comprising tobacco according to the method of claim 1.

14. The tobacco product of claim 13, configured as a smokeless oral-use tobacco product.

15. A method for curing tobacco for oral use, said method comprising steps of:

receiving green leaf tobacco;

removing midribs from leaves of the tobacco;

wilting the tobacco to reduce its moisture content to below about 70% but not below about 50%;

bruising the tobacco by cutting, chopping, tearing, and/or shredding it;

thereafter, aerating the tobacco in a manner configured to promote oxidation for a time of six hours or less; and drying the aerated tobacco to a moisture content below about 10%;

wherein the step of aerating comprises spreading the tobacco out substantially in a single layer upon a surface configured to provide air flow around the tobacco.

16. A tobacco product comprising tobacco according to the method of claim 15.

17. The method of claim 15, wherein the step of aerating is conducted for four hours or less.

* * * * *